US006509681B1

(12) United States Patent
Park et al.

(10) Patent No.: US 6,509,681 B1
(45) Date of Patent: Jan. 21, 2003

(54) DEFLECTION YOKE FOR COLOR CATHODE RAY TUBE

(75) Inventors: In-Kyu Park, Suwon-si (KR); Ji-Kwan Jeong, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 316 days.

(21) Appl. No.: 09/659,986

(22) Filed: Sep. 12, 2000

(30) Foreign Application Priority Data

Sep. 13, 1999 (KR) ..... 99-39055

(51) Int. Cl.[7] ..... H01J 29/70

(52) U.S. Cl. ..... 313/440; 335/213

(58) Field of Search ..... 313/440; 335/210, 335/213

*Primary Examiner*—Vip Patel

(74) *Attorney, Agent, or Firm*—Christie, Parker & Hale, LLP

(57) ABSTRACT

A deflection yoke for a color cathode ray tube is disclosed which is easily assembled. The deflection yoke has a separator, a ferrite core and a position holding unit provided to the separator and the ferrite core, for holding the ferrite core in a predetermined position with respect to the separator. The position holding unit comprises at least one pair of alignment parts consisting of a raised portion and a depressed portion, the raised portion and the depressed portion being provided on the ferrite core and the separator, respectively, and being fitted to each other.

7 Claims, 6 Drawing Sheets

DEFLECTION YOKE FOR COLOR CATHODE RAY TUBE

BACKGROUND OF THE INVENTION (a) Field of the Invention

The present invention relates to a deflection yoke for a color cathode ray tube, and more particularly, to a deflection yoke which is capable of improved assembling of a ferrite core and a separator in a color cathode ray tube.

(b) Description of the Related Art

In a well-known cathode ray tube, electron beams emitted from an electron gun assembly are deflected to a phosphor screen in horizontal and vertical directions. The electron beams impinge on a corresponding phosphor pixel, resulting in emission of light to form images or characters.

Cathode ray tubes are mainly installed in color televisions and computer monitors to be provided to consumers. Cathode ray tubes have also been enhanced to be installed in High-Definition televisions (HDTV).

Rectangular cathode ray tube cones on which the deflection yoke is mounted have recently been under development, and a ferrite core having a rectangular configuration similar to that of the cone is also being developed so that misconvergence can be minimized.

Color cathode ray tubes of the prior art are illustrated in FIGS. 1–4. A color cathode ray tube shown in FIG. 1 is formed with a vacuum envelope having a substantially rectangular panel 104, a funnel 106 formed contiguous to the panel 104, a cylindrical neck 110 formed contiguous to the funnel 106, and a deflection yoke DY mounted on a cone 106*a* of the funnel 106 near the neck 110. An electron gun 108 is mounted on the inside of the neck 110.

The interior cross section of the cone 106*a* of the funnel 106 is made to have a circular shaped cross-section at the neck 110, and becomes a substantially non-circular shape such as a rectangle towards the panel 104.

The deflection yoke as shown in FIG. 4, which is mounted on the cone 106*a*, comprises a separator 112 made of resin, a horizontal deflection coil 114 and a vertical deflection coil 116 mounted at the inside and outside of the separator 112, respectively, and a ferrite core 118 mounted at the exterior of the separator 112.

The separator 112 as shown in FIG. 2 is formed with a cone shape having a small diameter section 112*a* positioned at a neck of the cathode ray tube and a large diameter section 112*b* positioned at a funnel of the cathode ray tube, so that the interior cross section of the separator 112 is made in substantially a circular shape at the small diameter section 112*a,* then becomes a substantially non-circular shape such as a rectangle towards the large diameter section 112*b*. The separator 112 is formed with separated bodies which are joined to each other in an integrated form.

The ferrite core 118, as shown in FIG. 3, has a small diameter part 118*a* positioned at the neck of the cathode ray tube, and a large diameter part 118*b* positioned at the funnel of the cathode ray tube, so that the cross section of the ferrite core 118 is made to be a substantially circular shape at the small diameter part 118*a*, then becomes a substantially non-circular shape such as a rectangle towards the large diameter part 118.

It is possible to form the ferrite core 118 as an integrated form of one piece, or as a separated form where the ferrite core 118 is formed by two or more pieces to be clamped by core clamps 120.

Since the color cathode ray tube of the prior art has a substantially rectangular shape of the cone 106*a* and the separator 112 as well as the ferrite core 118, it is possible to effectively approximate the deflection coils 114 and 116 to the trajectories of the electrons emitted from the electron gun 108, resulting in the reduction of deflection power.

However, the color cathode ray tube of the prior art has some drawbacks. The ferrite core has desirable dimensions in order to allow for manufacturing tolerance of the vertical deflection coil, as well as to be easily mounted on the exterior of the separator on which the vertical deflection coil is already mounted. Therefore, a gap of 0.5–2 mm long occurs between the ferrite core and the separator when assembled. Due to the gap, the ferrite core may rotate around the separator, resulting in misalignment of the position and direction of the ferrite core. The misalignment of the position and direction is associated with an increase of the misconvergence, thereby reducing the deflection power efficiency.

Therefore, in order to avoid misalignment or rotation of the ferrite core, the prior art assembling process uses adhesives to fix the ferrite core on the separator after the ferrite core is disposed on the separator and adjusted to the correct position.

However, the prior art assembling process needs an additional fixing process, resulting in an increase of process time. Easy assemble of the ferrite core is required in the manufacturing process.

SUMMARY OF THE INVENTION

In view of the prior art described above, it is an object of the present invention to provide a deflection yoke for a color cathode ray tube capable of easily assembling a ferrite core on a separator.

To achieve this object, as embodied and broadly described herein, the invention comprises:

- a separator having a small diameter section positioned at a neck of the cathode ray tube and a large diameter section positioned at a funnel of the cathode ray tube, wherein a horizontal deflection coil and a vertical deflection coil are mounted on the inner surface and outer surface of the separator, respectively;
- a ferrite core mounted on the exterior of the separator, having a small diameter part positioned at the neck of the cathode ray tube, and a large diameter part positioned at the funnel of the cathode ray tube; and
- a position holding unit provided to the separator and the ferrite core, for holding the ferrite core in a predetermined position and direction with respect to the separator.

In an aspect of the present invention, the position holding unit comprises at least one pair consisting of a raised portion and a depressed portion, the raised portion and depressed portion being provided on the ferrite core and the separator, respectively, and being joined to each other.

In another aspect of the present invention, the position holding unit comprises a pin hole formed on the ferrite core and the separator, and a pin adapted for the pin hole.

Both the foregoing general description and the following Detailed Description are exemplary and are intended to provide further explanation of the invention as claimed.

BRIEF DESCRIPTION OF THE DRAWINGS

The accompanying drawings provide a further understanding of the invention and, together with the Detailed Description, explain the principles of the invention. In the drawings.

DETAILED DESCRIPTION OF THE PREFERRED EMBODIMENTS

The present invention will be described in detail with reference to the accompanying drawings.

Figure 1:
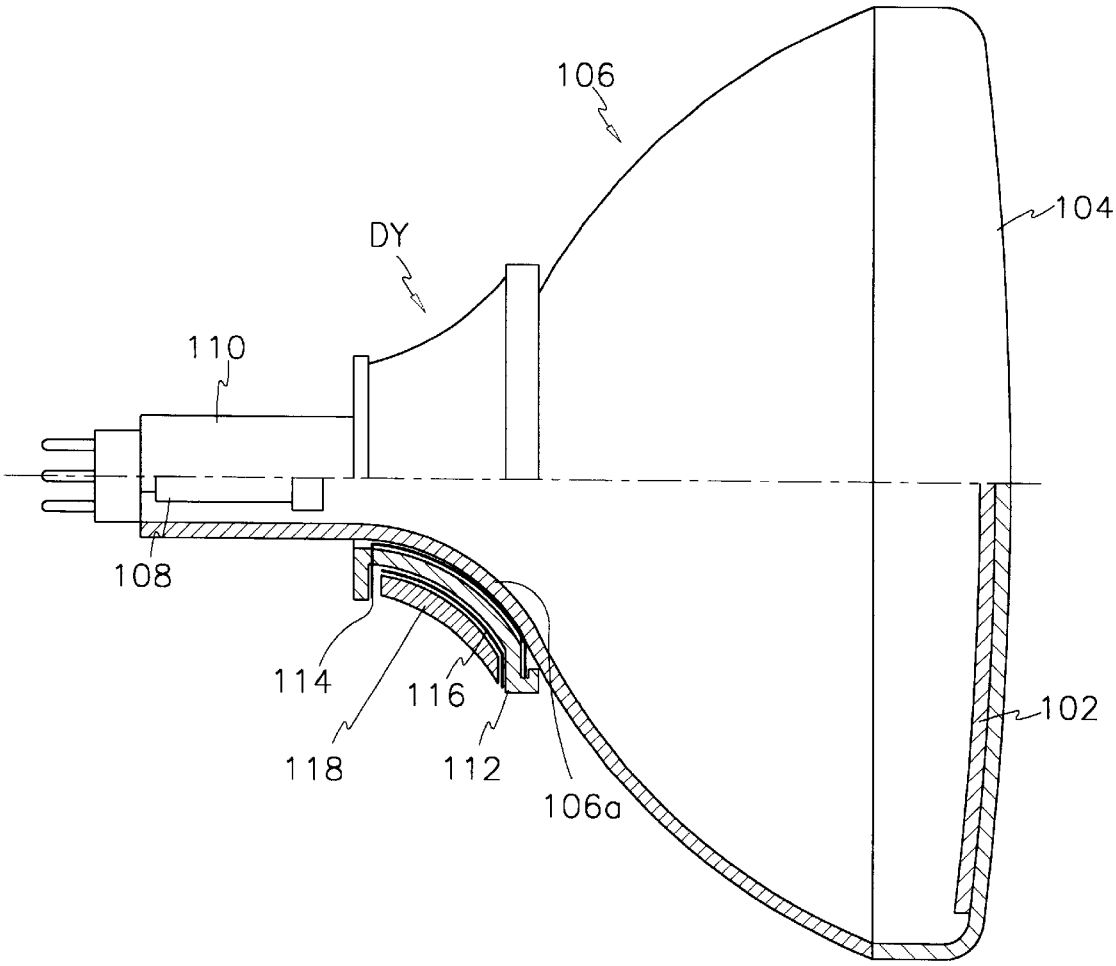
FIG. 1 (Prior Art)
FIG. 1 shows a cross section of a prior art cathode ray tube.
Figure 2:
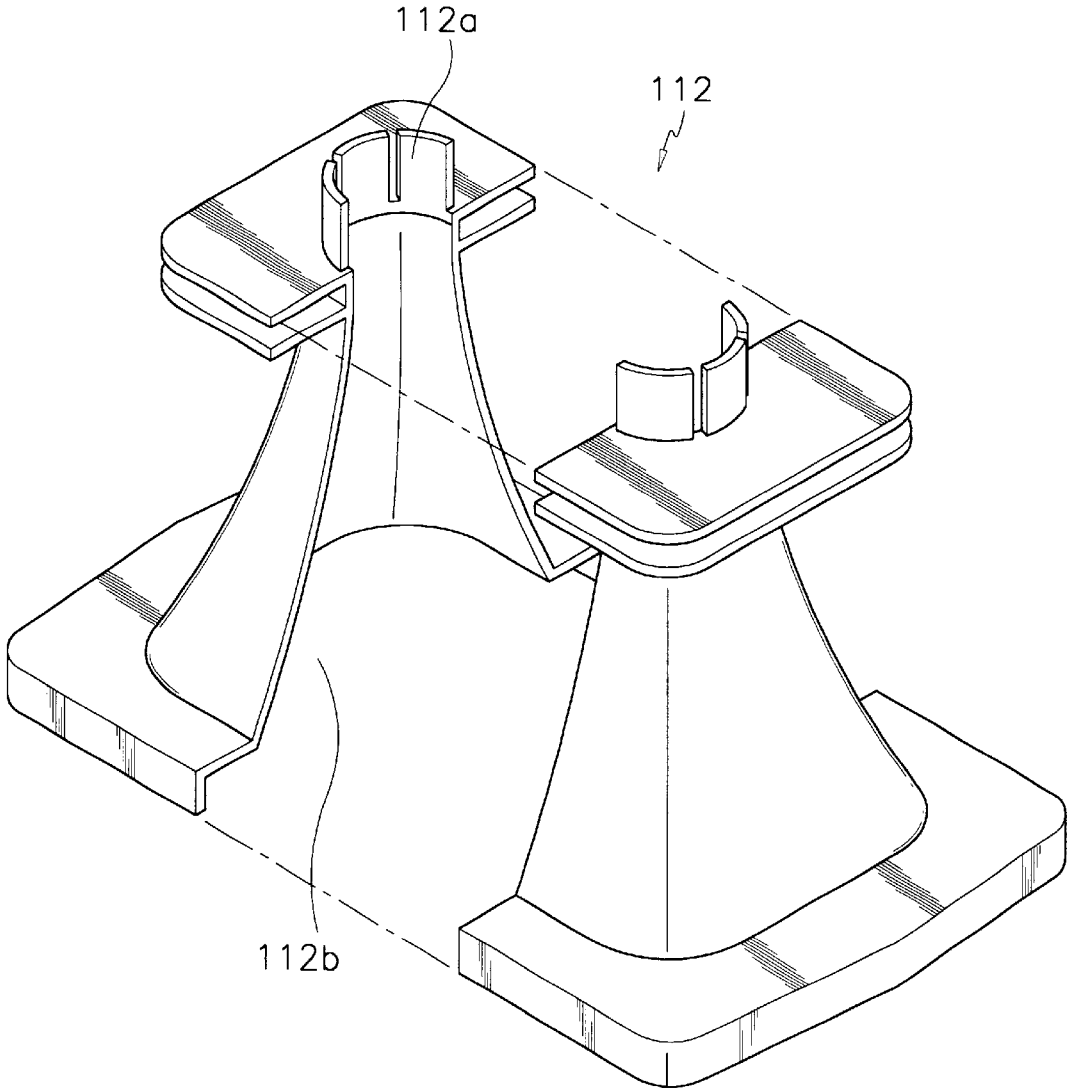
FIG.2(Prior Art)
FIG. 2 shows a prospective view of a conventional separator.
Figure 3:
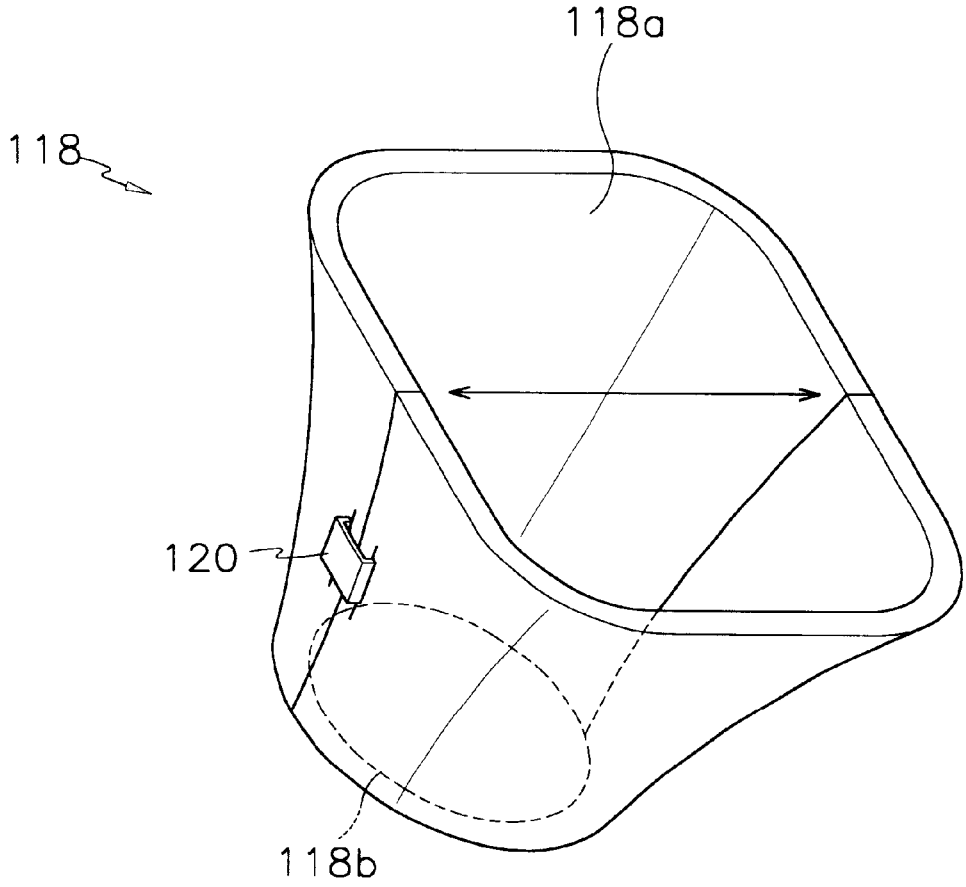
FIG.3(Prior Art)
FIG. 3 shows a prospective view of a conventional ferrite core.
Figure 4:
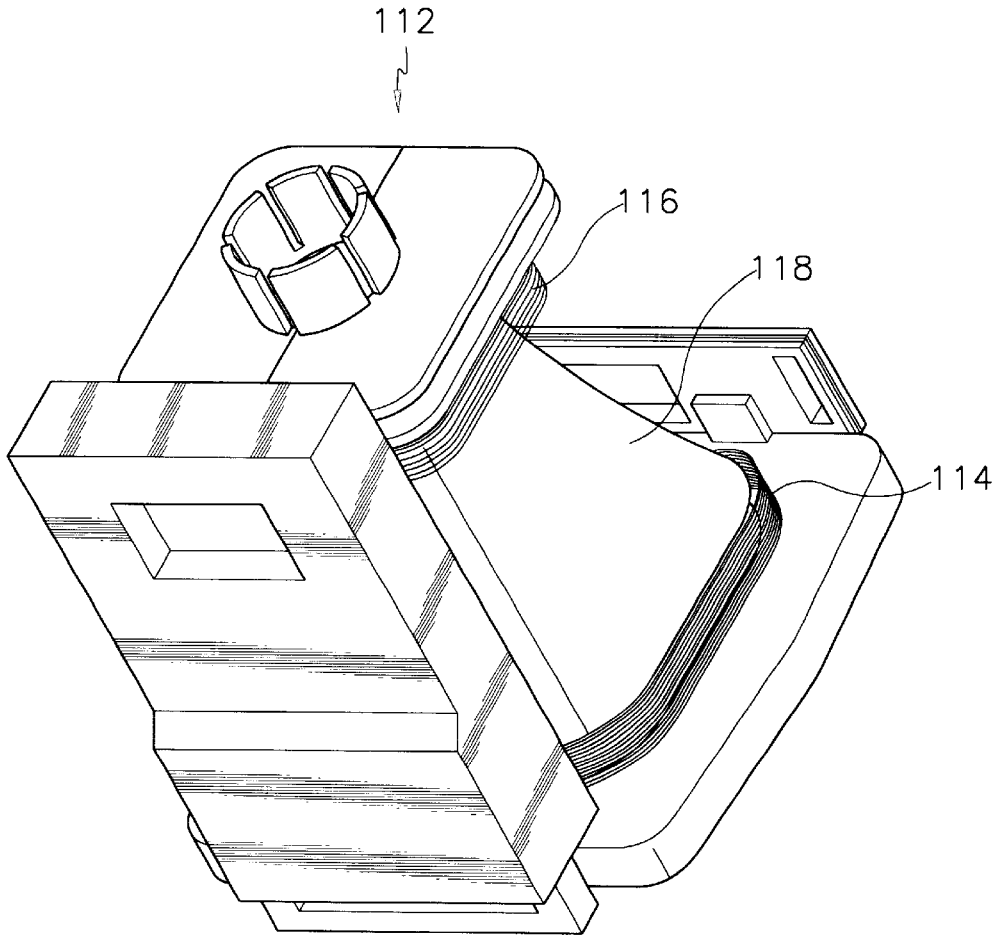
FIG.4(Prior Art)
FIG. 4 shows a deflection yoke assembly according to the prior art.
Figure 5:
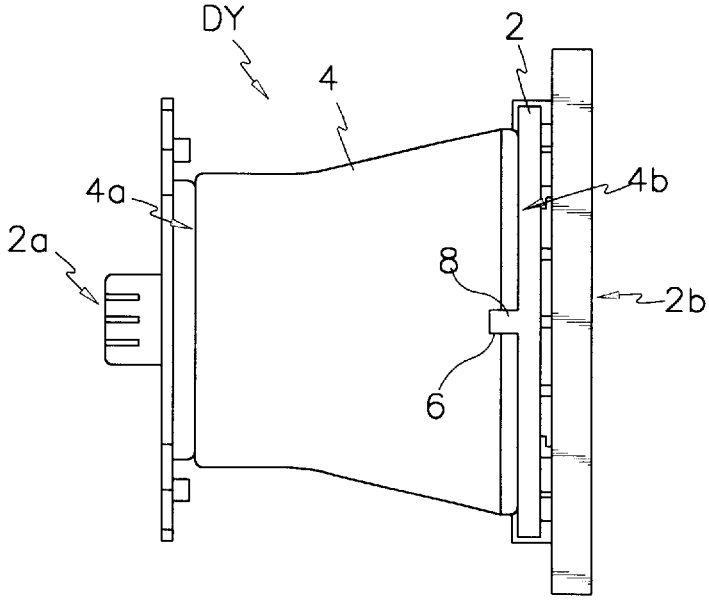
FIG. 5 shows a view of an assembled deflection yoke according to a first preferred embodiment of the present invention.

Referring to FIG. 5, a deflection yoke DY to be mounted on a cone of a cathode ray tube (not shown) comprises a separator 2, horizontal and vertical deflection coils (not shown) mounted at the inside and outside of the separator 2, respectively, and a ferrite core 4 mounted on the separator 2.

It should also be noted that although the ferrite core 4 is illustrated as an integrated form of one piece, for the sake of easy explanation, this ferrite core 4 may be constituted as a separated form comprised of two or more pieces.

The separator 2 is formed with a cone-shape having a small diameter section 2*a* positioned at a neck of the cathode ray tube and a large diameter section 2*b* positioned at a funnel of the cathode ray tube, so that the interior cross section of the separator 2 is made in a substantially circular shape at the small diameter section 2*a*, then becomes a substantially non-circular shape such as a rectangle towards the large diameter section 2*b*. The separator 2 is formed with separated bodies which are joined to each other in an integrated form.

The ferrite core 4 has a small diameter part 4*a* positioned at the neck of the cathode ray tube, and a large diameter part 4*b* positioned at the funnel of the cathode ray tube, so that the cross section of the ferrite core 4 is made to be a substantially circular shape at the small diameter part 4*a*, then becomes a substantially non-circular shape such as a rectangle towards the large diameter part 4*b*.

The deflection yoke DY further comprises a position holding unit provided to the separator 2 and the ferrite core 4, in order to enhance ease of assemble of the ferrite core 4 into the separator 2, as well as to prevent the ferrite core 4 from rotating with respect to the separator 2 for tightly holding the ferrite core 4 and the separator 2.

The position-holding unit will now be explained in detail. A depression 6 having a predetermined depth is formed on the large diameter part 4*b* of the ferrite core 4 against the small diameter part 4*a*. A raised portion 8 is formed to protrude on the outer surface of the large diameter section 2*b* of the separator, to be inserted into and couple with the depression 6.

It is preferred to make a width of the raised portion 8 larger than that of the depression 6, so there is a friction fit between the raised portion 8 and the depression 6.

After horizontal and vertical deflection coils (not shown) are mounted on the inside and outside of the separator, respectively, the raised portion 8 is inserted into the depression 6 as the ferrite core 4 is inserted into the large diameter section 2*b* from the small diameter section 2*a* of the separator 2. The assembling of the ferrite core 4 and the separator 2 is then completed and maintained by the friction fit between the raised portion 8 and the depression 6.

Therefore, the use of adhesives and the additional manufacturing process of adjusting the ferrite core 4 by using the position-holding unit are eliminated.

Figure 6:
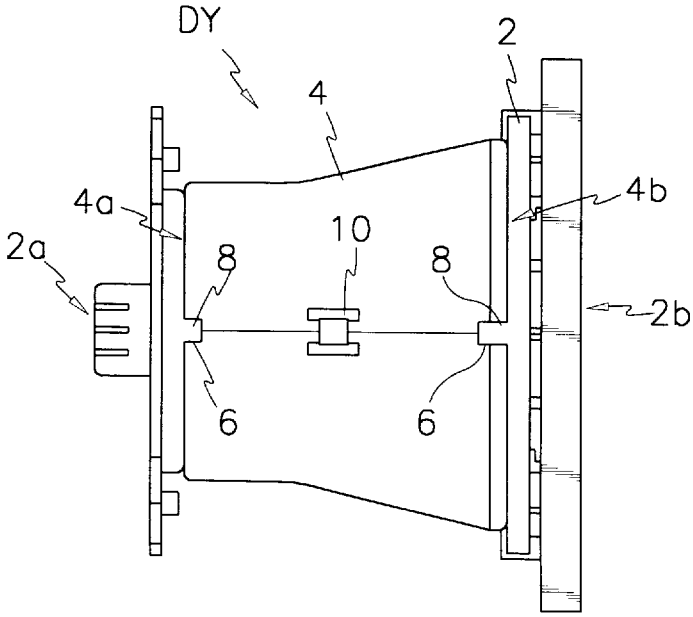
FIG. 6 shows another configuration of the first preferred embodiment shown in FIG. 5.
Figure 7:
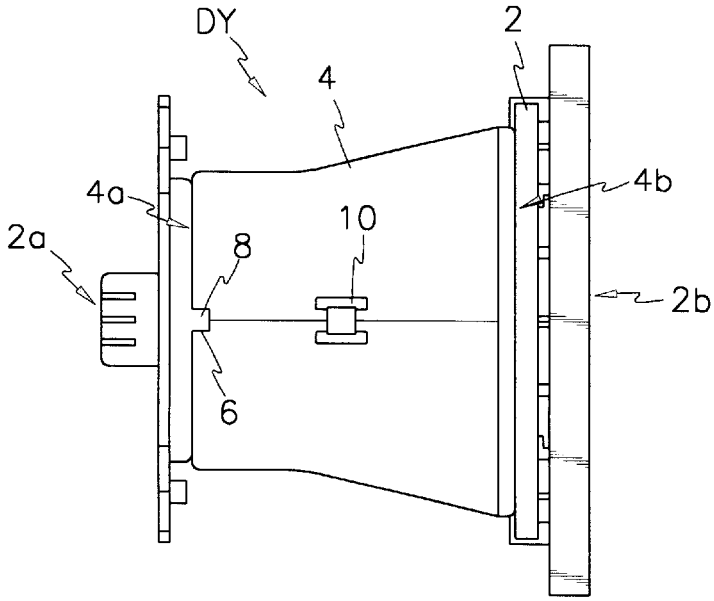
FIG. 7 shows still another configuration of the first preferred embodiment shown in FIG. 5.

Referring to FIGS. 6–7, another example of the position-holding unit is illustrated. As shown in FIG. 6, depressions 6 are formed on both the small diameter part 4*a* and large diameter part 4*b* of the ferrite core 4. Correspondingly, mating raised portions 8 are formed on both the small diameter section 2*a* and large diameter section 2*b* of the separator 2. As shown in FIG. 7, it is possible to form a depression 6 on the small diameter part 4*a* of the ferrite core 4 while a mating raised portion 7 is formed on the small diameter section 2*a* of the separator.

The configuration shown in FIGS. 6–7 applies to the case when the ferrite core 4 is formed in several pieces to be clamped together by core clamps 10.

Figure 8:
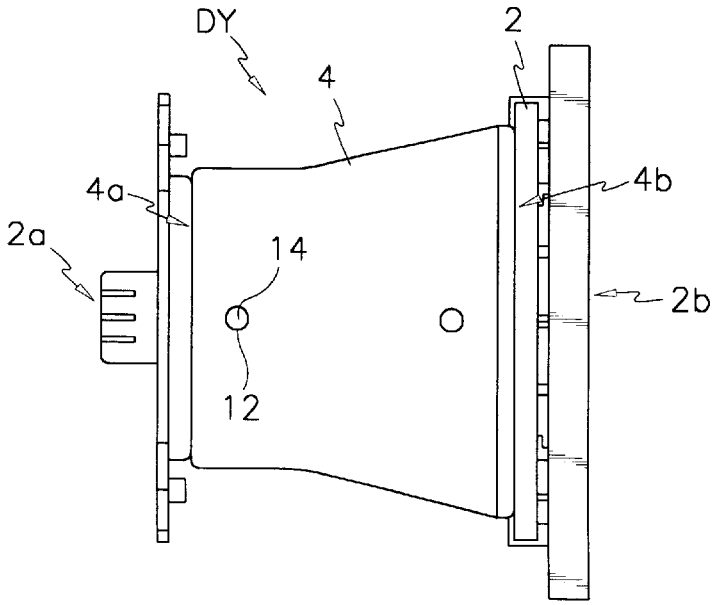
FIG. 8 shows a view of an assembled deflection yoke according to a second preferred embodiment of the present invention.

Referring now to FIG. 8, another embodiment of the deflection yoke will be described. A deflection yoke DY that is mounted on a cone of a CRT (not shown) comprises a separator 2, horizontal and vertical deflection coils (not shown) mounted at the inside and outside of the separator, respectively, and a ferrite core 4 mounted at the separator 2.

Although the ferrite core 4 is illustrated as an integrated form of one piece, for the sake of easy explanation, this ferrite core 4 may be constituted as a separated form.

The separator 2 has at least two pin holes 12 on the predetermined position. Further, the ferrite core 4 has pin holes of the same number as those of the separator 2. It is preferred that the pin holes are formed on the region on which the both the horizontal deflection coil and the vertical deflection coil are not mounted.

When assembling, the horizontal and vertical deflection coils (not shown) are mounted on the separator 2. The ferrite core 4 is inserted into the separator 2 and adjusted until the pin holes 12 of both the ferrite core 4 and the separator 2 are aligned. Then the mating pins 14 are inserted into the pin holes 12 so that the assembling of the ferrite core 4 and the separator 2 is completed and maintained in position by coupling between the pin holes 12 and the pins 13.

Therefore, the use of adhesives and the additional manufacturing process of adjusting the ferrite core 4 are eliminated.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A deflection yoke for a color cathode ray tube comprising:

a separator having a small diameter section positioned at a neck of the cathode ray tube and a large diameter section positioned at a funnel of the cathode ray tube, wherein a horizontal deflection coil and a vertical deflection coil are mounted on the inner surface and outer surface of the separator, respectively;

a ferrite core mounted on the exterior of the separator, having a small diameter part positioned at the neck of the cathode ray tube, and a large diameter part positioned at the funnel of the cathode ray tube; and a position holding means provided to the separator and the ferrite core, for holding the ferrite core in a predetermined position and direction with respect to the separator.

2. The deflection yoke as recited in claim 1, wherein the separator and the ferrite core have cross sections of substantially rectangular shapes.

3. The deflection yoke as recited in claim 2, wherein the position holding means comprises at least one pair of alignment parts consisting of a raised portion and a depressed portion, the raised portion and the depressed portion being provided on the ferrite core and the separator, respectively, and being fitted to each other.

4. The deflection yoke as recited in claim 3, wherein the raised portion and the depressed portion are formed on the large diameter part of the ferrite core and the large diameter section of the separator, respectively.

5. The deflection yoke as recited in claim 3, wherein the raised portion and the depressed portion are formed on the small diameter part of the ferrite core and the small diameter section of the separator, respectively.

6. The deflection yoke as recited in claim 3, wherein the raised portion is formed on the ferrite core while the depressed portion is formed on the separator.

7. The deflection yoke as recited in claim 2, wherein the position holding means comprises a pin hole formed on the ferrite core and the separator; and a pin adapted for the pin hole.

* * * * *